United States Patent [19]

Morrison

[11] 3,950,801

[45] Apr. 20, 1976

[54] COMBINATION JAR AND CAN OPENER

[75] Inventor: Howard J. Morrison, Deerfield, Ill.

[73] Assignee: Marvin Glass & Associates, Chicago, Ill.

[22] Filed: Dec. 6, 1974

[21] Appl. No.: 530,290

[52] U.S. Cl. ..... 7/14.25; 81/3.2; 81/3.33

[51] Int. Cl.[2] ..... B25B 7/44

[58] Field of Search ..... 7/14.2 R, 14.25, 14.1 R; 81/3.2, 3.1 R, 3.3 R, 3.31, 3.32, 3.33; 53/381 R

[56] References Cited

UNITED STATES PATENTS

| | | | |
|---|---|---|---|
| 1,016,513 | 2/1912 | Newcomb | 81/3.32 |
| 2,656,084 | 10/1953 | Filander | 81/3.32 |
| 3,795,158 | 3/1974 | Morita | 81/3.32 |

*Primary Examiner*—Al Lawrence Smith
*Assistant Examiner*—Roscoe V. Parker
*Attorney, Agent, or Firm*—Coffee & Sweeney

[57] ABSTRACT

An apparatus for loosening threaded lids from jars or similar containers having screw-type lids. The apparatus includes a rotatable bottom support platform having a friction pad for supporting and rotating the container, and a top, vertically movable friction pad for engaging the threaded lid whereupon rotation of the bottom support platform rotates the container relative to the lid for loosening the lid to facilitate removal. The apparatus includes a drive motor which is energized as the top friction pad is biased downwardly and into engagement with the lid of the container. Alternatively, the drive motor can rotate the support platform in an opposite direction to seal jar lids for use during canning. The apparatus also includes a can opener on the underside of the apparatus housing which is operated by the same drive motor. When used as a can opener, the upper friction pad of the apparatus can be pivoted to a folded position after which the entire apparatus can be turned over to be supported on a side of the housing providing convenient access to the can opener drive gear.

19 Claims, 8 Drawing Figures

3
54
4
14
58
56
42
74
40
72
48
16
10
50
50
30
150
150
163a
12
178
88
20
31
78
24
82
26
216
4
3

54
46
14
56
58
42
74
72
70
40
48
16
216
204
78
210
18
208
202
200
206
82
12
150
178
28
26
31
32

20
80
88
78
82
80

54
68
60
58
14
56
44
40
70
90
42

16
150
156
158
156
160
162
166
168
170
164
172
186
180
174
163
163a
163

152
154
144
166
150
31
146
163a
169
12
156
164
163
30
20
94
82
96
98
132
130
126
132
128
110
118
140
141
129
100
102
104
112
120
142
143
222
220
224
218
106
108
114
116
124
200
202
204
32
28
26

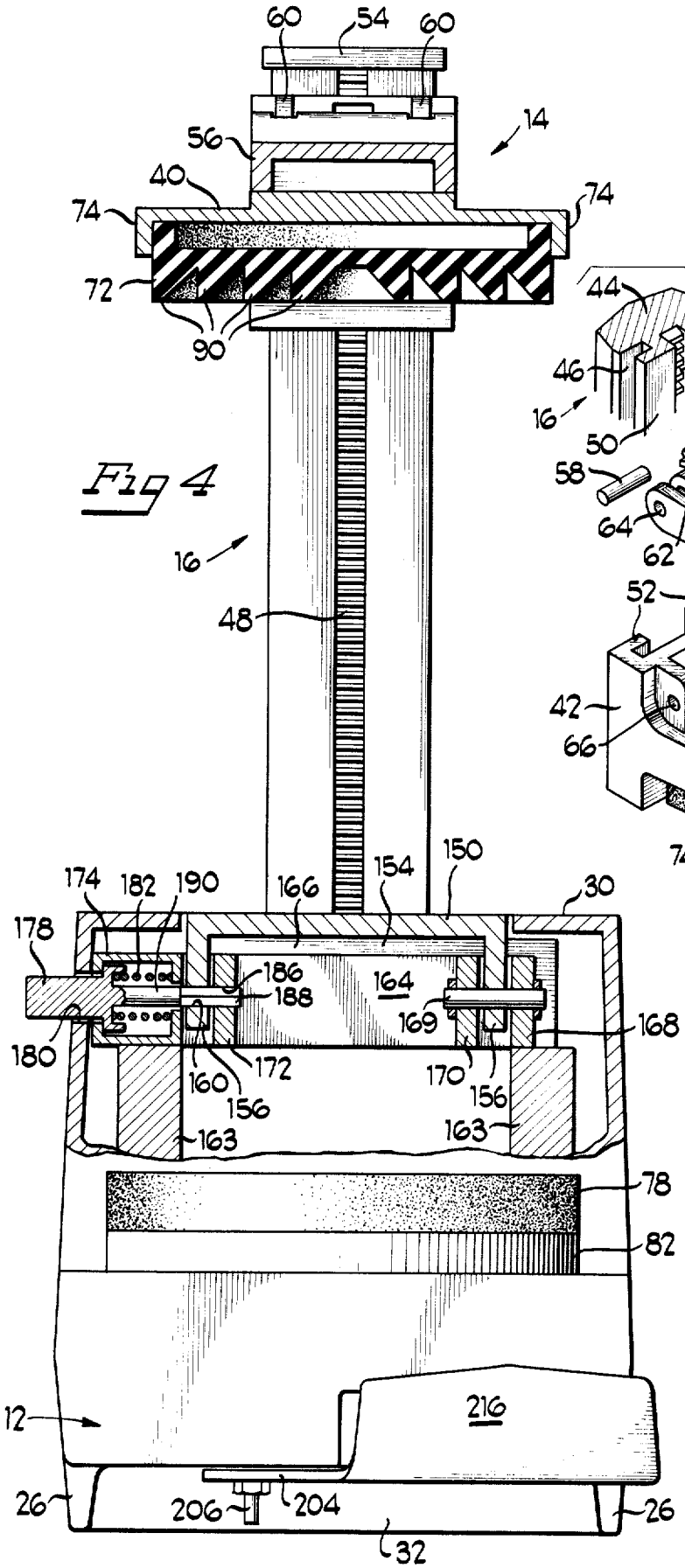
Fig 4
Fig 6
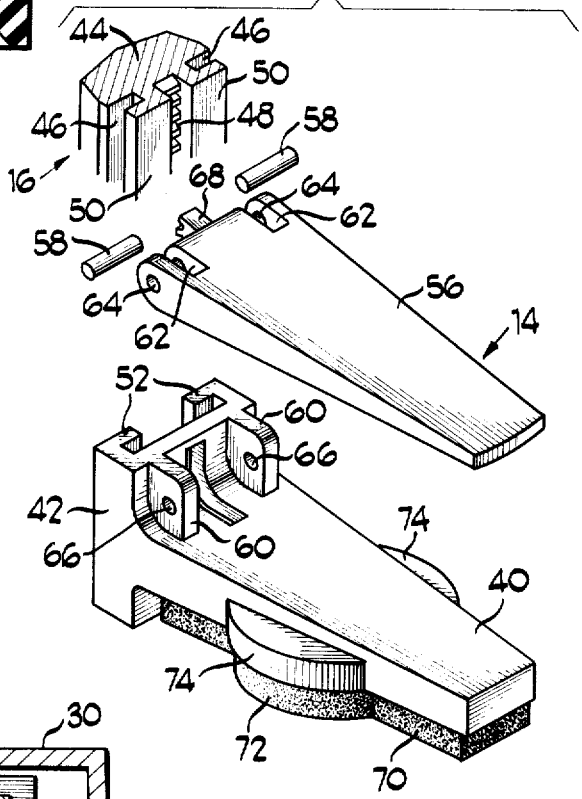
Fig 5
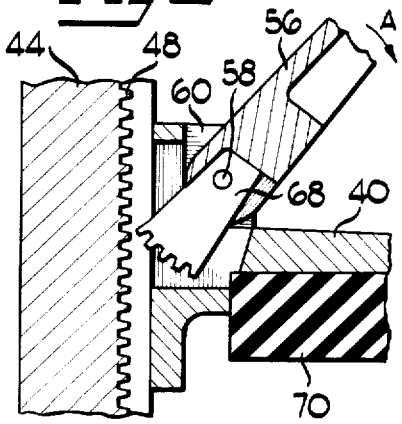

COMBINATION JAR AND CAN OPENER

BACKGROUND AND SUMMARY OF THE INVENTION

The present invention is directed in brief toward a container opener and in particular to a device for closing or opening closures for containers or jars which are sealed with a twist lid and also for opening containers which are sealed with crimped lids such as conventional cans.

Electric can openers have been produced and have obtained general acceptance with the public as a useful device for opening conventional crimped cans. However, apparatus for removing threaded lids from jars or similar containers have only been produced in limited quantities and generally for commercial or industrial uses such as food manufacturers. Threaded lids have been found to be extremely practical for jars or other containers intended to contain such goods as preserved foodstuffs, medicine and household cleaners, since they provide a positive and durable seal of the products enclosed therein. Most of these containers are sealed at the manufacturer's site by a commercial type sealer. As a result of the friction between the lid and the container generated by the sealing machines, a considerable force is required to loosen the lid when the container is opened for the first time.

Although a number of jar openers have been produced, none of the suggested openers have provided a convenient jar opener which requires little or no manual force to be applied to the container and lid. This has presented many problems particularly for women, the elderly and the young since they do not often possess the strength required to overcome the sealing friction.

Particularly, the tong or wrench type openers enable the user to apply a greatly magnified force to the lid of the container but still require a considerable manual force to be applied directly to the jar which is often made of glass and is difficult to hold against the rotation of the lid.

The object of the present invention is to provide a new and improved jar opener which is powered by an electric motor and which requires very little force to be exerted by the user for opening a jar or other container.

In the preferred embodiment of the present invention a slightly modified, conventional can opener is provided where the can opener motor also provides the power for opening threaded lids from jars. When opening a jar, the can opener is positioned with its normal front face, containing the rotatable knife edge and the gear for engaging the lip of a can which is recessed on the underside of the housing, facing downward on a table or other suitable supporting surface. A generally vertical chuck support column is pivotally mounted on the can opener housing and supports a vertically positionable chuck which frictionally engages the threaded cap. A rotatable platform is mounted on the can opener output shaft for supporting a jar in an upright position and rotating the jar relative to the upper chuck. The chuck includes clamp means to bias the chuck into engagement with a lid and the biasing force thereby generated actuates the drive means which causes the jar or container to be rotated relative to the lid to thereby loosen the lid for easy removal by the consumer. The motor can be reversible to permit tightening a lid on a jar, e.g., in preservative "canning."

BRIEF DESCRIPTION OF THE DRAWINGS

FIG. 4 is a vertical section, on an enlarged scale, taken generally along the line 4—4 of FIG. 1;

FIG. 5 is a fragmented view of the clamp means in an unclamped position;

FIG. 6 is an exploded perspective view of the chuck and clamp means components of the present invention;

DESCRIPTION OF THE PREFERRED EMBODIMENT

Figure 1:
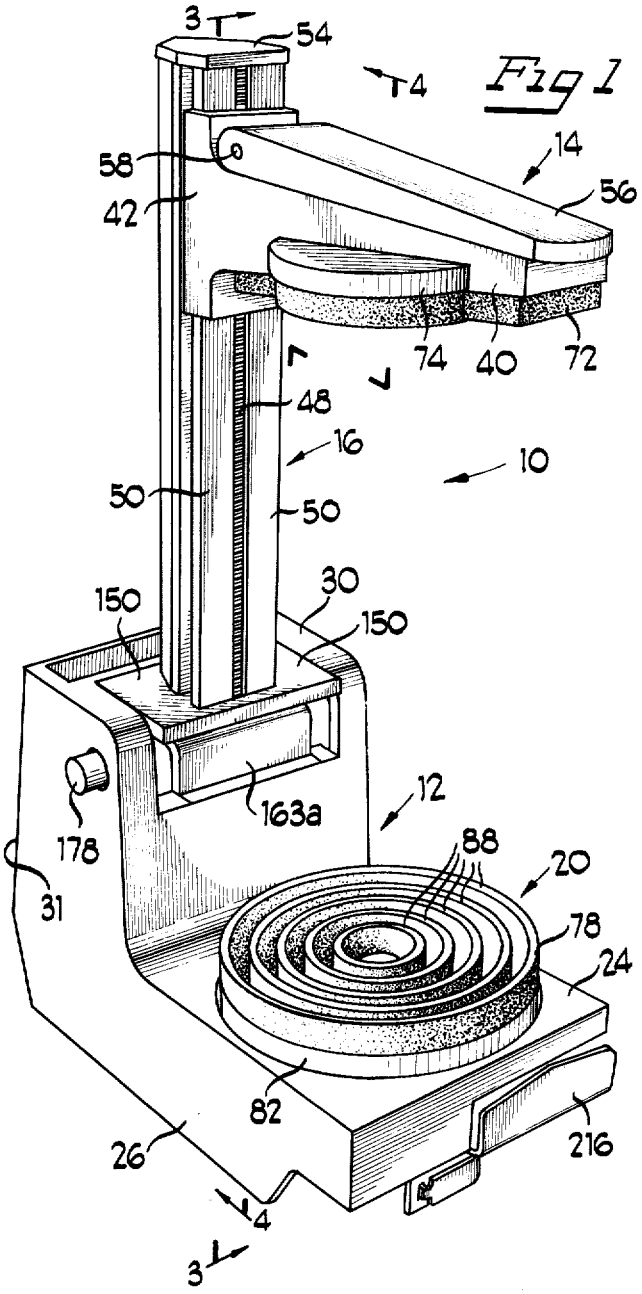
FIG. 1 is a perspective view of the apparatus embodying the concepts of the present invention showing the apparatus in an open position as for use as a jar opener.

Referring to FIG. 1, the apparatus of the present invention, generally designated 10, includes a housing, generally designated 12, a vertically positionable chuck, generally designated 14, and a chuck support column, generally designated 16. The housing 12 mounts a can opener, generally designated 18 (FIG. 2), and a rotatable platform, generally designated 20.

Figure 2:
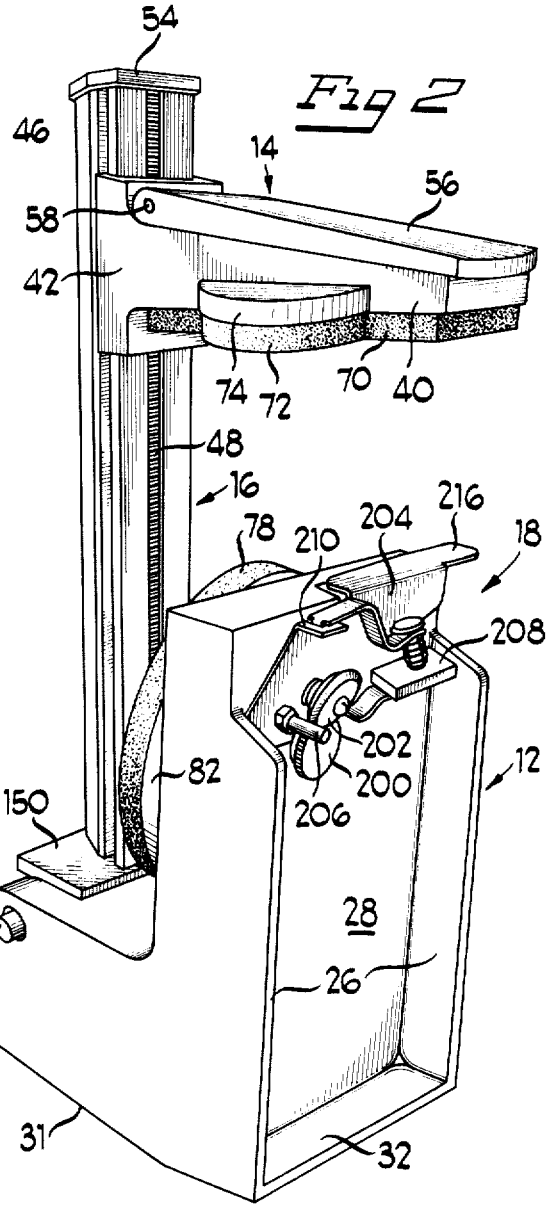
FIG. 2 is another perspective view of the present invention showing the apparatus in a folded and turned position for use as a can opener.
Figures 3, 7:
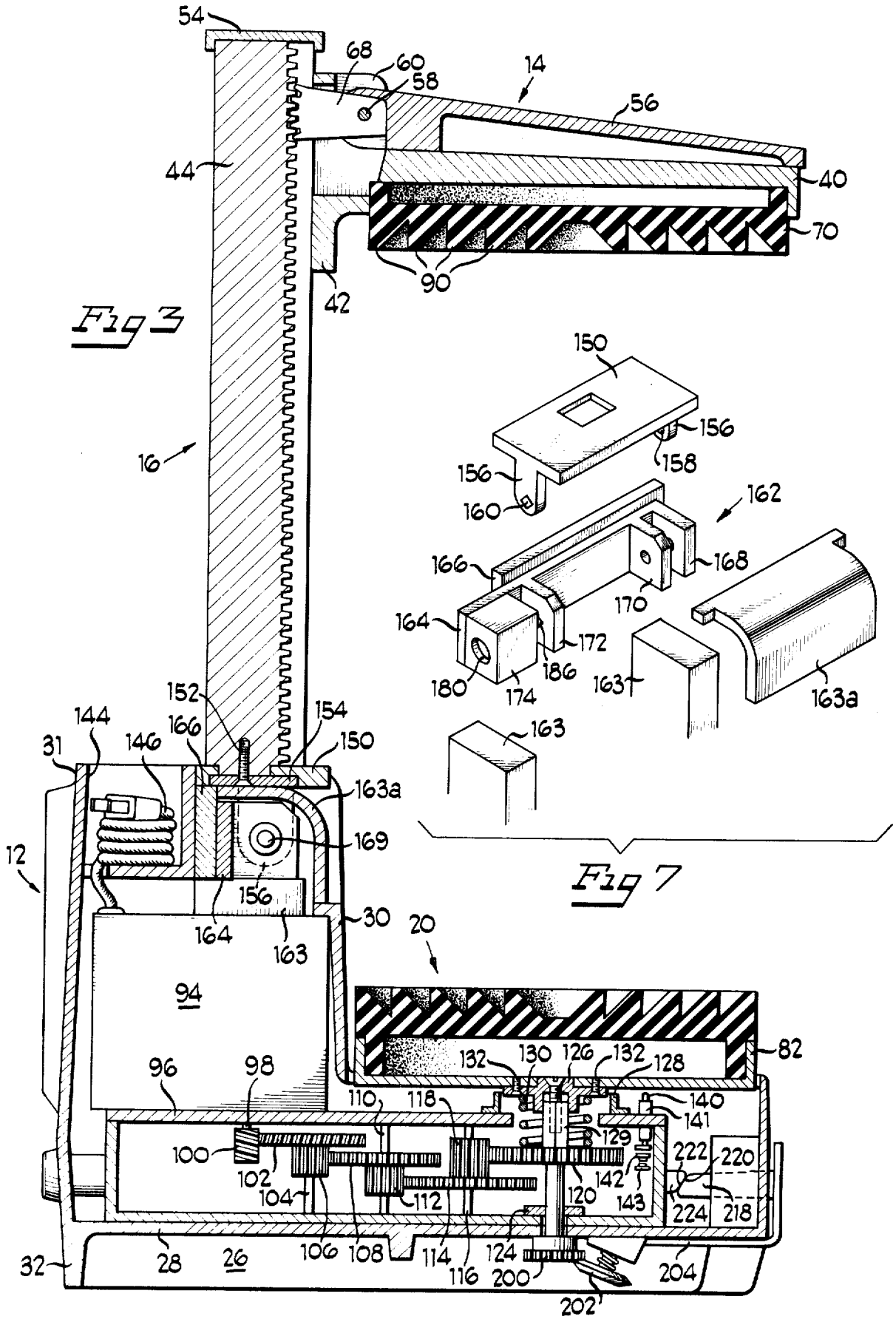
FIG. 3 is a vertical section, on an enlarged scale, taken generally along the line 3—3 of FIG. 1.
FIG. 7 is an exploded perspective view of the pivotal mounting components of the chuck support column of the present invention.

The apparatus will be described first with reference to its jar opening function as shown in FIG. 1, and all references as to vertical and horizontal orientations will be directed toward the apparatus as shown in position in FIG. 1. More particularly, the housing 12 as seen in FIGS. 1 and 3 is generally L-shaped having a longer, horizontal base portion 24 for supporting the apparatus in its jar opening function. The base 24 includes two side walls 26 which extend past a bottom wall 28 of the housing 12 to form a recess between a pair of parallel ribs for engaging the supporting surface. The housing 12 also includes a vertical portion 30 which mounts the chuck support column 16 with the back wall 31 thereof (FIG. 1), providing a third recess defining supporting flange 32 (FIG. 2).

Referring to FIG. 6 and the top of FIGS. 1 and 3, the chuck 14 includes a horizontally extending tapered arm 40 which is formed on a slidable mounting bracket 42. The top of FIG. 6 illustrates the cross sectional configuration of the chuck support column 16. This column 16 includes a solid, rigid column portion 44 which has a vertical slot 46 cut therein on both sides near the front surface. The front center of the support column 44 is formed with a gear rack 48 for clamping the chuck as will be described in detail hereinafter. The slots 46 and the rack 48 provide two outwardly directed L-shaped flanges 50 for slidably mounting the chuck 14. The mounting bracket 42 includes two inwardly directed L-shaped flanges 52 which engage the slots 46 and maintain the chuck 14 in a generally horizontal position. This attachment means permits the chuck 14 to slide up and down on the column 16 so that it can be positioned and used to clamp any size jar or other container. A top end plate 54 is fastened to the top of the column 16 to prevent removal of the chuck 14 which could become lost.

Clamp means including a clamp arm 56 is mounted above the tapered chuck arm 40 by a pair of pins 58. The pins pivotally mount the clamp arm 56 on a pair of tabs 60 formed on the mounting bracket 42 above the chuck arm. Two slots 62 are formed in the clamp arm to permit the arm 56 to slide into engagement with the tabs 60 for the introduction of the pins 58 into the holes 64 in the clamp arm 56 and holes 66 in the mounting bracket ribs 60.

Referring to FIG. 5, the clamp arm 56 carries a rearwardly directed arcuate pinion 68 for engagement with the rack 48. FIG. 5 illustrates the unclamped position which permits the chuck 14 to be moved vertically within the slots 46. When it is desired to clamp a jar in the apparatus for removing the lid, the chuck 14 is lowered until a flexible resilient friction pad 70 engages the lid of the container to be opened. Friction pad 70 includes two semi-circular enlargements 72 near its center portion which is directly above the rotatable platform 20. Two similar semi-circular sections 74 are provided on the horizontal rib 40 for supporting the flexible friction pad elements 72. When clamping a jar in place, the friction pad 70 engages the lid of the container, then the clamp arm 56 is pivoted downwardly in the direction of arrow A (FIG. 5) so that the pinion 68 engages the rack 48 and forms a fulcrum to apply force to the lid on top of the container.

Figure 8:
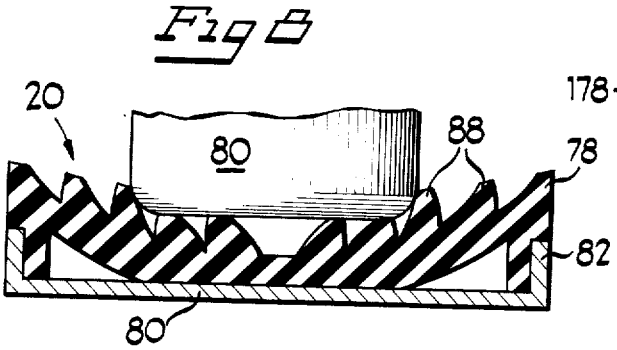
FIG. 8 is a cross sectional view of the rotatable support platform showing the deformation of the platform ribs by a jar clamped in the apparatus.

Looking at FIG. 8, the rotatable platform 20 also includes a resilient friction pad 78 for engagement with the bottom of a jar or container 80. The friction pad 78 is mounted on a circular disc 80 which includes a circumferential flange 82 for additional surface area contact between the friction pad 78 and the disc 80 which may be secured together, as by adhesives. The lower friction pad 78 and the central portion of the upper friction pad 70 include a plurality of concentric ribs 88 and 90, respectively. The ribs are provided to add additional biasing forces and thereby generate additional friction between the pad and the jar or lid respectively. As seen in FIG. 8, as the clamp arm 56 is rotated downwardly into engagement with the lid on top of a container 80, the circular ribs 88 or 90 in engagement with the jar 80 deform slightly to add biasing and frictional forces.

The clamping action of the chuck 14 also will energize a drive motor 94 mounted within the housing 12. The drive motor 94 is mounted on an internal, generally rectangular frame 96 within the housing 12. A motor shaft 98 extends downwardly through one wall of the frame 96 and includes a pinion gear 100. The pinion gear 100 is in meshing engagement with a larger gear 102 mounted on a shaft 104 within the frame 96. The gear 102 carries a smaller pinion gear 106 which is in meshing engagement with another larger gear 108 mounted on a shaft 110 in the frame 96. Likewise the gear 108 carries a pinion gear 112 which engages a third larger gear 114 mounted on a shaft 116 within the frame 96. The gear 114 carries a final pinion gear 118 which is in meshing engagement with a larger drive gear 120. The drive gear 120 is mounted on an output shaft 122 which is supported in the frame 96 in a lower stationary bearing 124 and an upper, vertically movable, bearing 126. The movable bearing is mounted within a circular flange 128 mounted on the upper surface of the internal frame 96. The upper bearing 126 can move vertically along the axis of a square portion 129 of the output shaft 122 while remaining within the bearing 128. The upper bearing 126 also is biased upwardly, away from the output drive gear 120 by a coil spring 130. The rotatable platform disc 80 is secured to the upper bearing 126 by a plurality of screws 132. As the clamp means biases a container 80 downwardly against the rotatable support platform 20, the platform moves downwardly, slightly, against the biasing force of the spring 130 which causes the bottom of the disc 80 to engage a spring biased plunger 140. The plunger 140 is mounted within a sleeve 141 and will engage and close a set of electrical contacts 142 and 143 which energizes the drive motor 94. The series of gears as described between the pinion gear 100 and the output shaft gear 120 greatly reduces the rotational speed of the output shaft relative to the motor while likewise greatly increasing the available torque. This torque, from the relatively small drive motor 94, enables the apparatus to rotate the jar or container 80 relative to the lid thereof which is maintained in a non-rotatable position by the chuck 14. This movement, then loosens the lid of the jar and permits the user to easily remove the lid from the jar after the chuck 14 is unclamped. The large mechanical advantage provided by the pinion gear 68 and the rack 48 enables persons to open tightly sealed threaded containers with a minimum of force and effort. Although not shown, it is contemplated that the apparatus 10, alternatively, may include a bi-directional motor 94, or a reverse gear within the gear train, so that it may be used to tighten lids on containers. Such an option would greatly increase the utility of the apparatus such as in home canning operations.

A small recess 144 (FIG. 3) is provided behind the chuck support column 16 to store an electrical cord 146 for the drive motor 94.

The chuck support column 16 is pivotally mounted to the base portion 30 so that it can be rotated downwardly to a generally horizontal position when it is desirable to use the apparatus 10 as a can opener as illustrated in FIG. 2. More particularly, referring to FIGS. 3 and 7, the chuck support column 16 is mounted on a pivotal support plate 150 by a plurality of screws 152 through a generally flat plate 154. The suppot plate 150 includes two downwardly directed tabs 156. One tab has a circular hole 158 for pin mounting to the housing and the other tab has a square hole 160 for mounting to the housing and to enable locking of the column 16 in a vertical or horizontal position as will be described hereinafter. A mounting hinge, generally designated 162, is secured within the vertical portion of the housing on a pair of upstanding studs 163 adjacent the rear cavity 144 for mounting the column 16. A cover plate **163*a* is mounted in front of the hinge 162** to hide the hinge components from view.

More particularly, the mounting hinge 162 includes a transverse rib 164 mounted to a back plate 166 fastened to the housing 12. The righthand end as shown in FIG. 7, of the transverse rib 164 includes two ribs 168 and 170. The tab 156 of the mounting plate 150 is fastened between the ribs 168 and 170 by a pin 169 for pivotal support. Similarly, the lefthand end of the transverse plate 164, referring to FIG. 7, includes a tab 172 and a generally rectangular hollow box portion 174. Selectively operable locking means in the form of a spring biased plunger 178 (FIG. 4) is mounted within the box portion 174 and extends through an aperture 180 in the left side thereof as seen in FIG. 4. The plunger 178 is biased by a small coil spring 182 outwardly (to the left in FIG. 4). A square hole 186, similar to the square hole 160, is provided in the tab 172. A square peg or pin 188 is provided on the end of plunger 178 to simultaneously engage both the square hole 186 and 160 to maintain the column 16 in a vertical position. When it is desired to rotate the column to a horizontal position, for using the apparatus as a can opener, the user simply presses the plunger 178 inwardly causing a circular portion 190 of the plunger to pass into the square hole 160 and thereby allow the colunn to be rotated downwardly. After 90° of rotation, the plunger 178 can be released and the square portion 188 of the plunger will maintain the column in a closed, horizontal position for storage as shown in FIG. 2 to enable the entire housing 12 to be rotated 90° and supported by the wall 31 of the base portion 30 for use as a can opener, without requiring the space that would be necessary if the column 16 were not movable. This use as a can opener 18 is shown in FIG. 2.

The can opener portion 18 is generally similar to can openers presently on the market. The output shaft 122 also is used for the can opener. More particularly, a gear 200 is mounted to the output shaft 122 on the opposite end thereof from the rotatable platform 20. A rotatable knife edge 202 is rotatably mounted to a movable force arm 204. The arm 204 is pivotally mounted by a pin 206 to the face 28 of the can opener housing 12. A magnetic lid pickup 208 is pivotally mounted to a flange 210 formed on the arm 204. The arm 204 carries a flat flange 216 for applying pressure and which is flush with the front of the housing 12 (FIG. 1). Operation of the can opener is similar to presently available commercial devices. The rim of the can is placed in engagement with the gear 200 and the arm 204 is pivoted to bring the knife edge downwardly into engagement with the inside rim to shear the lid away from the can. The magnetic pickup 208 prevents the lid from falling down into the food item within the can. The drive motor 94 is energized as the arm 204 causes the knife edge to cut into the can. A spring biased plunger 218 within the housing extends outwardly so as to engage the flange portion 216 when it is depressed. The plunger 218 includes a canted surface 220 which is in engagement with a similar canted surface 222 of a vertically movable stud 224. The movable stud 224 is connected to the lower contact 143 which moves therewith to close the contact seat 142 and 143 to energize the motor 94. Thus, vertical movement of the plunger 140 or horizontal movement of plunger 218 will close the contact set 142 and 143 so that either will energize the motor and the can opener can be used independently of the jar opener.

The foregoing detailed description has been given for clearness of understanding only and no unnecessary limitations should be understood therefrom as some modifications will be obvious to those skilled in the art.

I claim:

1. An apparatus for loosening or tightening threaded lids from containers or jars, comprising:

a housing;

a generally vertical upwardly extending chuck support column mounted on the housing;

a rotatable platform mounted on the housing for supporting a container in an upright position and rotating the container;

a chuck vertically movably mounted on the support column above the rotatable platform for selective vertical positioning along the support column and for frictionally engaging a threaded lid on the container;

manually operable clamp means operatively associated with the support column and the chuck to bias the chuck downwardly into engagement with the lid; and drive means mounted on the housing in driving relationship with said support platform whereby actuation of the drive means causes the platform and the container thereon to rotate relative to the lid and chuck and thereby break the seal between the lid and rim of the container.

2. The apparatus of claim 1 wherein the chuck and the rotatable platform each include a pad of soft resilient material to engage the top of the lid and the bottom of the container and to provide friction therebetween while the platform rotates the container relative to the lid.

3. The apparatus of claim 1 wherein the clamp means includes a gear rack formed on the support column and a locking arm pivotally mounted on the chuck, said locking arm including an arcuate pinion portion for engaging the rack whereby rotation of the locking arm biases the chuck into frictional engagement with the lid of the container.

4. The apparatus of claim 1 wherein the support column is pivotally mounted on the housing for movement between a generally vertical operating position and a generally horizontal storage position.

5. The apparatus of claim 4 including a can opener mounted on the housing on a side thereof remote from said support column and rotatable platform and movable into operative position by turning the housing onto its side with said support column in its storage position.

6. The apparatus of claim 5 wherein said can opener is driven by said drive means for the rotatable platform.

7. The apparatus of claim 5 wherein said can opener is disposed in a recess of the underside of said housing when said housing is in position for said support column to extend vertically upwardly therefrom whereby when the housing is turned over onto one side thereof the can opener is exposed for operation.

8. The apparatus of claim 4 including selectively operable locking means to hold said support column in either its operating position or its horizontal storage position.

9. The apparatus of claim 1 including switch means for actuating said drive means, said switch means being operatively associated with said rotatable platform whereby said switch means is closed in response to the biasing force of said clamp means being transferred through the container to said rotatable platform to actuate said drive means.

10. The apparatus of claim 9 wherein said rotatable platform is vertically movable by said biasing force into engagement with said switch means to close the switch means and actuate said drive means.

11. The apparatus of claim 1 wherein said drive means is reversible so as to provide for tightening a lid onto a container.

12. An apparatus for removing threaded lids from jars and opening crimped lids from cans comprising, in combination:

a housing having means defining a first surface for supporting the apparatus when used for opening jars and a second surface for supporting the apparatus when used for opening cans; and drive means having an output shaft rotatably mounted in said housing, with a rotatable platform of a jar opening device mounted on one end of the output shaft for supporting a jar in an upright position when said housing is supported on said first surface, and at least a portion of a can opening device on the opposite end of the output shaft for engaging the rim of a can when said housing is supported on said second surface.

13. The apparatus of claim 12 wherein the jar opening device includes a chuck support column mounted on the housing and extending generally upwardly therefrom when the housing is supported on said first surface, a chuck vertically movably mounted on the support column above the rotatable platform for selectively vertical positioning along the support column and for frictionally engaging a threaded lid on a jar, and manually operable clamp means operatively associated with the support column and the chuck to bias the chuck downwardly into engagement with the lid.

14. The apparatus of claim 12 including switch means for actuating said drive means in response to pressure from said clamp means onto said rotatable platform, said can opening device including a handle portion having a rotatably mounted knife edge, the handle portion actuating said switch means on movement thereof to drive said knife edge into the crimped lid of a can.

15. An apparatus for loosening or tightening threaded lids from containers or jars comprising:

a housing;

a generally vertical upwardly extending chuck support column mounted on the housing;

a rotatable platform mounted on the housing for supporting a container in an upright position and rotating the container;

a chuck vertically movably mounted on the support column for frictionally engaging a threaded lid on the container;

drive means on the housing in driving relationship with said support platform whereby actuation of the drive means causes the platform and the container thereon to rotate relative to the lid and chuck and thereby break the seal between the lid and rim of the container; and means pivotally mounting the support column on the housing for movement between a generally vertical operating position and a generally horizontal storage position.

16. An apparatus for loosening or tightening threaded lids from containers or jars comprising:

a housing;

a generally vertical upwardly extending chuck support column mounted on the housing;

a rotatable platform mounted on the housing for supporting a container in an upright position and rotating the container;

a chuck vertically movably mounted on the support column for frictionally engaging a threaded lid on the container;

drive means on the housing in driving relationship with said support platform whereby actuation of the drive means causes the platform and the container thereon to rotate relative to the lid and chuck and thereby break the seal between the lid and rim of the container; and switch means for actuating said drive means, said switch means being operatively associated with said rotatable platform whereby said switch means is closed in response to downward biasing forces from said chuck being transferred through the container to said rotatable platform to actuate said drive means.

17. The apparatus of claim 16 wherein said rotatable platform is vertically movable by said biasing force into engagement with said switch means to close the switch means and actuate said drive means.

18. An apparatus for removing threaded lids from jars and opening crimped lids from cans comprising, in combination:

a housing having means defining a first surface for supporting the apparatus when used for opening jars and a second surface for supporting the apparatus when used for opening cans;

a chuck support column mounted on the housing and extending generally upwardly therefrom when the housing is supported on said first surface;

a rotatable platform mounted on the housing for supporting a jar in an upright position and rotating the jar when the housing is positioned on said first surface;

a chuck vertically movably mounted on the support column above the rotatable platform for frictionally engaging a threaded lid on the jar and applying vertical forces thereto when the housing is supported on said first surface;

a can opening device on the housing for engaging the rim of a can and supporting the can in an upright position when the housing is supported on said second surface; and drive means mounted on the housing in driving relationship with said support platform whereby actuation of the driving means causes the platform and the jar thereon to rotate relative to the lid and chuck and thereby break the seal between the lid and rim of the jar when the apparatus is being used as a jar opener, the drive means being operatively associated with at least a portion of the can opening device for operating the same when the apparatus is used as a can opener.

19. The apparatus of claim 18 including means pivotally mounting said support column on the housing for movement between a generally vertical operating position when the housing is supported on said first surface and a folded position when the housing is supported on said second surface for use as a can opener.

* * * * *